United States Patent [19]

Fernandez

[11] 4,393,948

[45] Jul. 19, 1983

[54] ROCK BORING BIT WITH NOVEL TEETH AND GEOMETRY

[75] Inventor: Carlos Fernandez, West Covina, Calif.

[73] Assignee: Boniard I. Brown, West Covina, Calif.

[21] Appl. No.: 249,814

[22] Filed: Apr. 1, 1981

[51] Int. Cl.[3] ..... E21B 10/16

[52] U.S. Cl. ..... 175/374; 175/378; 175/376

[58] Field of Search ..... 175/375, 374, 376, 377, 175/378

[56] References Cited

U.S. PATENT DOCUMENTS

| | | | |
|---|---|---|---|
| 1,856,627 | 5/1932 | Fletcher | 175/375 |
| 1,885,085 | 10/1932 | Dalzen | 175/374 |
| 2,038,386 | 4/1936 | Scott et al. | 175/377 X |
| 2,177,332 | 10/1939 | Reed | 175/376 |
| 2,216,938 | 10/1940 | Crum | 175/374 |
| 4,202,419 | 5/1980 | Youngblood | 175/374 |

*Primary Examiner*—Ernest R. Purser
*Assistant Examiner*—Michael J. Starinsky
*Attorney, Agent, or Firm*—Boniard I. Brown

[57] ABSTRACT

A rock boring bit assembly which includes a body configured for engagement with associated driving mechanism. At least one roller cutter is rotatably mounted on the body. The roller cutter includes a plurality of cutting member disposed about the entire face or surface thereof in generally upstanding relationship. The cutting members are arrayed over the roller cutter surface with no channel between adjacent arrays of cutting members. The cutters have generally rectilinear edges and each of the edges is disposed in substantially oblique relationship to a plurality of other rectilinear edges of other cutting members disposed proximate thereto.

12 Claims, 9 Drawing Figures

ROCK BORING BIT WITH NOVEL TEETH AND GEOMETRY

BACKGROUND OF THE INVENTION

The present invention relates to the art of rock boring and more particularly to a rotary bit which comprises three toothed conical rotary elements on which are disposed hard metal tips. The tips may be inserts. Such bits are typically rotated under the weight of a drill collar and drill pipe. This weight forces the bits into the rock or other ground formations and the rotation causes the rotatably mounted cones to rotate about their own axes. The teeth or tips chip and crush the rock or other formations.

While particularly adapted for drilling oil wells, it will be understood that it also has application for other ground boring requirements.

The prior art drill bit assemblies have usually been constructed with channels or other non-cutting areas between rings of teeth. These areas have been provided, in the prior art devices, for the purpose of providing cleaning clearance for the cutting teeth. The present inventor has found that this theory and construction are based on an incorrect theoretical basis. More particularly, such cleaning clearances result in recompressing material which has been cut off and chewed up by adjacent teeth or rows of teeth. The practical effect of the use of such grooves is to substantially reduce the number of cutting teeth which may be disposed on a given size cone, thus reducing rates of penetration in drilling operations.

The prior art drill bit also typically has teeth which have elongated cutting edges which are disposed in generally parallel relationship to the axis of rotation of the cone. A difficulty with these prior art drill bits, is that the resultant force on the cone is inclined substantially from the axis of rotation. This results in a spiralling action of the drill bit, as it drills down into the ground.

Various drill bit constructions, such as those shown in U.S. Pat. Nos. 3,385,385, 4,187,922, and 2,990,025, have not proven wholly satisfactory.

It is an object of the invention to provide apparatus which will provide more rapid drilling and improved penetration rates, even when drilling relatively hard rock.

An object of the invention is to provide apparatus which will inherently tend to move in a more rectilinear path as it passes down into the ground, and which tends to avoid the spiralling action of the prior art drill bits, while accomplishing the other objects of the invention.

An object of the invention is to provide apparatus which distribute the wear of the cutting teeth over substantially all the cutting teeth of each cone so that the life of the cone is maximized.

Another object of the present invention is to provide drill bit apparatus which will provide improved durability and longer service life.

Another object of the invention is to provide a construction which reduces overloading, shock loads and load variations imposed on the cone bearings so that the bearing life will be substantially increased over the prior art construction.

SUMMARY OF THE INVENTION

A rock boring bit assembly which includes a body configured for engagement with associated rotating mechanism. At least one roller cutter is rotatably mounted on a leg on a bearing pin. The roller cutter includes a plurality of cutting edges disposed over the face thereof in generally upstanding relationship to the face thereof. The cutters are so arrayed or arranged as to define no channel between adjacent arrays, pluralities or rings of cutters. The cutters have an edge which is generally rectilinear and each of the rectilinear edges are disposed in substantially oblique relationship to the plurality of other rectilinear edges of other cutting members disposed proximate thereto.

The cutting members may be arrayed over the entire surface of the roller cutter or cone, and may be arrayed in rows of staggered, offset cutting members.

The apparatus may have the cutting members or inserts disposed in rings or ring areas. Each of the rings may extend through a plane which is substantially perpendicular to the axis of the cone. The inserts in adjacent rings may be disposed with substantially no space intermediate adjacent rings. Each cone may further include an additional ring of inserts disposed most remote from the apex of each cone and has the geometric axis of each insert disposed in substantially normal relationship to the geometric axis of the cone.

The apparatus may further include still another ring of inserts which are each disposed with the axis of each at an angle which is intermediate the normal relationship (to the axis) of the ring of cutter inserts which are most remote from the apex and the inserts which are disposed in normal relationship to the surface of the cone. The additional ring of inserts may be disposed axially intermediate the ring which is most remote from the apex and the cutter inserts disposed elsewhere on the cone.

BRIEF DESCRIPTION OF THE ACCOMPANYING DRAWINGS

DESCRIPTION OF THE PREFERRED EMBODIMENT

Figure 1:
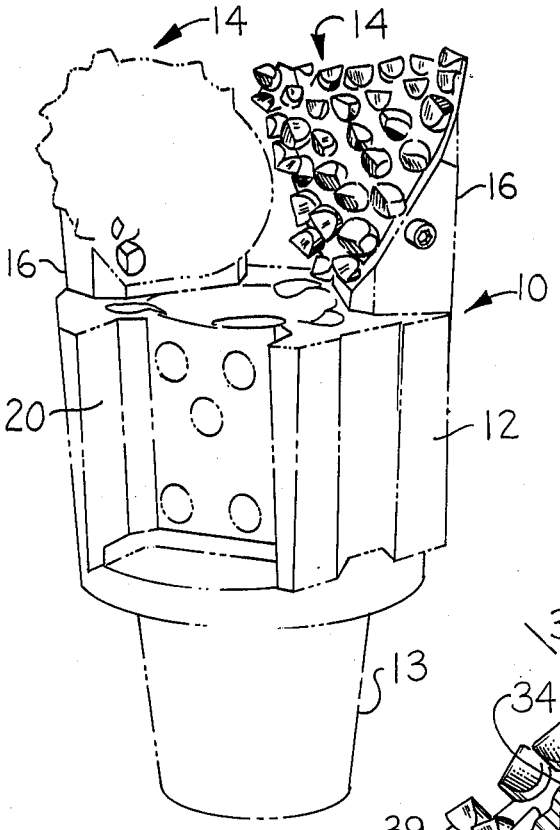
FIG. 1 is a fragmentary perspective view of the drill bit assembly in accordance with the invention, in which one cone and the associated mounting structure has been omitted to improve the clarity of the view.

Referring now to FIGS. 1–7 there is shown a drill bit assembly 10 which includes a body 12 having threaded surfaces thereon (not shown) for attachment to the lower end of a rotary drill string (not shown). The drill bit assembly includes three cones or cutters 14 (two shown in FIGS. 1 and 7). Each cone or cutter 14 is provided with a threaded pin or support shaft 18 which engages the leg 16 on which the cone 14 is mounted. A recess 19 in the threaded surface of the pin 18, is provided for cooperation with a dowel pin and safety screw (not shown) to more positively secure the pin 18 to the leg 16. Each leg 16 is dimensioned and configured for engaging a recess 20, in the body 12. The legs 16 are fastened to the body 12 by means of socket bolts 17. The body 12 is bolted to the threaded pin 13 by socket bolts 15.

Figure 4:
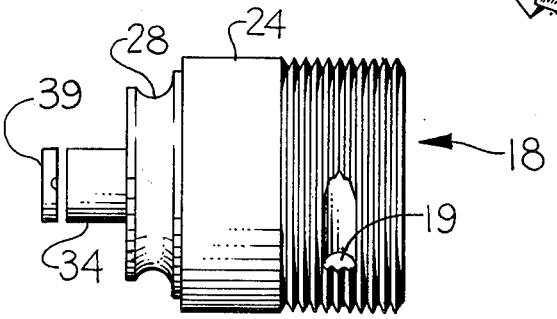
FIG. 4 is an elevational view of the pin portion of the internal structure of the cone illustrated in FIGS. 1–3, and which omits the bearing rollers illustrated in FIG. 3.
Figure 5:
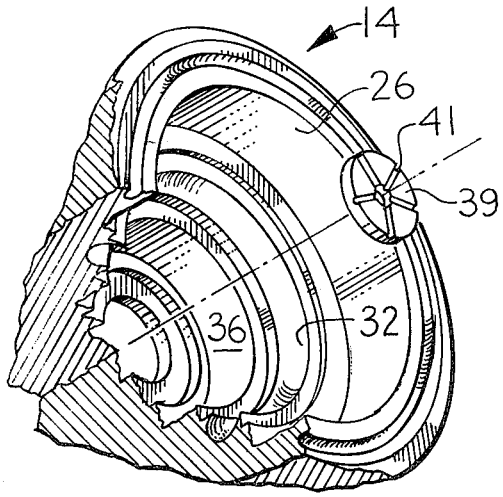
FIG. 5 is a fragmentary perspective view of the internal construction of the cone illustrated in FIGS. 1–4.

Each cone is provided with a plurality of bearing systems which cooperate with the bearing pin or support shaft 18. The bearing systems include a roller bearing 24 on the pin 18 which cooperates with the surface 26 of the cone and the pin shaft. The pin 18 is also provided with an inner bearing race 28 which cooperates with ball bearing 30 which are in turn carried in an outer race 32. Another roller bearing 34 cooperates with a bearing surface 36 in the interior of the cone (which is best seen in FIG. 5). A thrust plate 39 is provided in the cone 14 to absorb thrust forces in the multiple bearing and is positioned against the end face of the pin shaft, as shown in FIG. 4. Grooves 41 are provided in the thrust plate 39 to insure positive lubrication. Although this combination of bearing systems has been illustrated, it will be understood that the invention also contemplates the use of other bearing systems, such as axially tapered journal bearings and tapered roller bearings.

Figure 6:
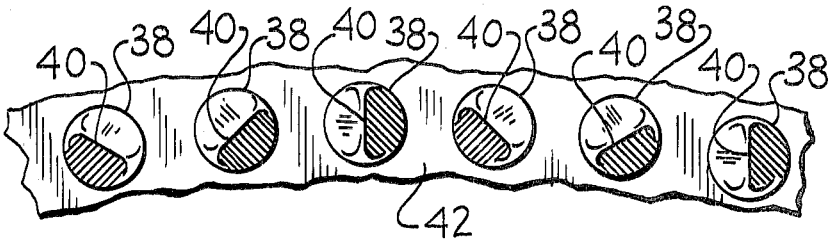
FIG. 6 is a fragmentary elevational view of a section of cone, illustrating the geometric relationship between the successive inserts in a ring shaped array in one embodiment of the invention.
Figure 7:
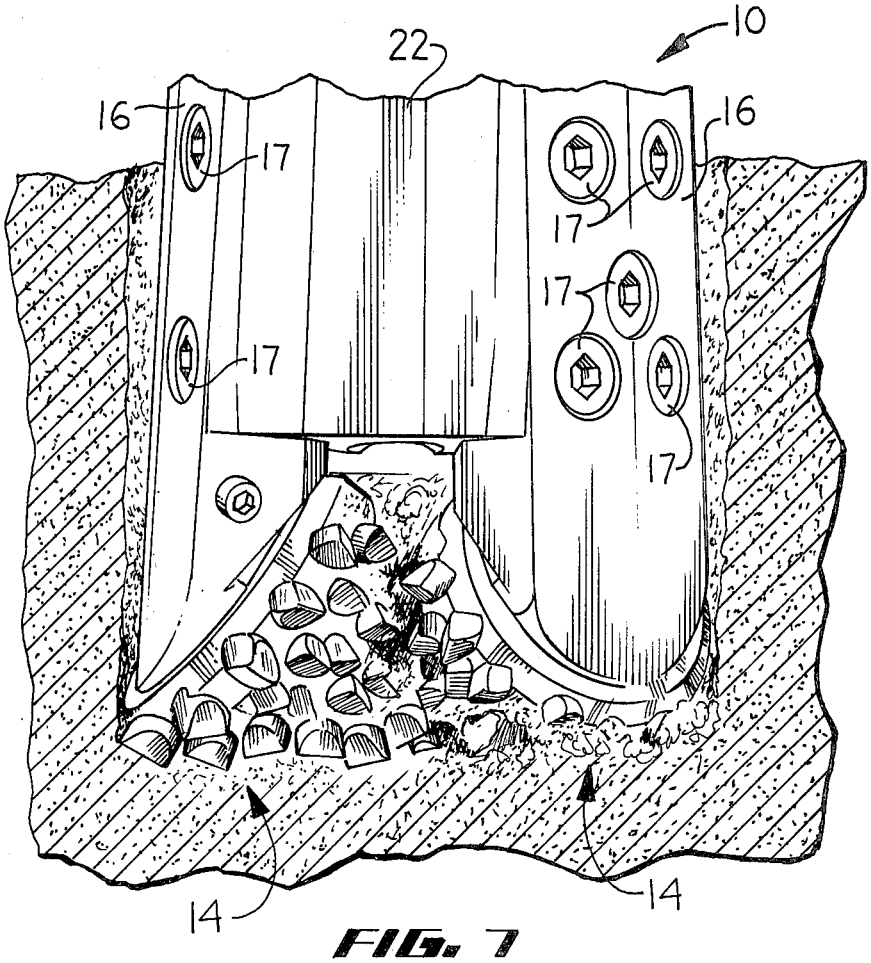
FIG. 7 is a perspective view of the drill bit assembly of FIG. 1, showing the bit and teeth during drilling operation.
Figure 8:
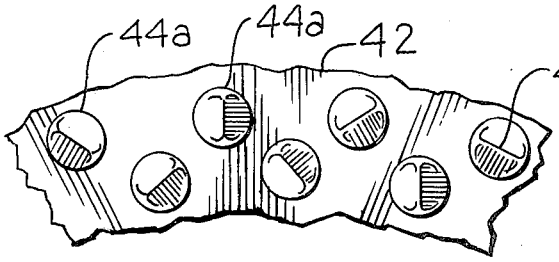
FIG. 8 is a fragmentary elevational view, similar to that of FIG. 6, showing another embodiment of the invention.

Disposed on the outer face of each cone 14 are a plurality of metal inserts 38 which are generally arrayed in circumferential rows which are disposed very generally in planes which extend substantially at right angles to the geometric axis of the cone. As best seen in FIGS. 2, 7 and 8, the inserts are generally disposed so that there is substantially no space or channel left intermediate adjoining rows (contrary to the usual prior practice for such drill bits). The inserts 38 are ordinarily welded in bores or recesses in the cone 14. As is best seen in FIG. 6, the free end of each insert 38 (which may be manufactured of hardened steel or tungsten carbide) includes a generally rectilinear edge 40. In the embodiment shown in FIGS. 1–7, the orientation of the edge 40 of each insert 38 in any one row or ring is in general not parallel to and is oblique to the axis of the cone, and to the edge 40 of the adjacent inserts 38 in the same array or ring, the insert edges of which follow or track each other in successively engaging an area of rock or material being drilled. Ordinarily, each edge 40 of each insert 38 will also be disposed in oblique relationship to each other edge 40 of each insert 38 which is adjacent thereto even if it is in a different row or ring. Similarly, in the embodiments of FIGS. 6 and 9, successive insert edges are in oblique or inclined relation to each other and to a plurality of other proximate insert cutting edges. Successive cutting edges in a ring or array therefore engage or impact an area of the formation or rock being drilled at varying successive relative directions, thus resulting in more effective breakage, more rapid penetration by the drill bit, and reduction of tracking and stumbling of the successive cutting edges.

Figure 9:
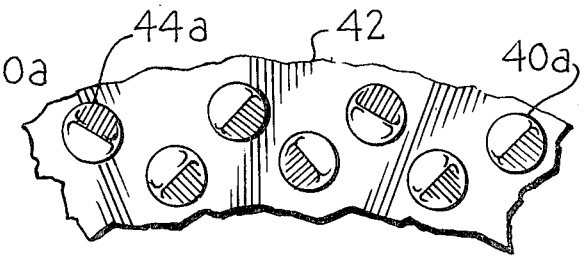
FIG. 9 is a fragmentary elevational view, similar to that of FIG. 8, illustrating another embodiment of the invention.

With cutting edges inclined to the axis of the cone, as shown in FIGS. 6, 8 and 9, end portions of cutting edges first engage the rock or material being broken, thus effecting high penetration pressure and reducing the tracking, stumbling, jumping, and breaking of cutting members which otherwise results from engagements or impacts of full cutting edges with the rock or formation. In the embodiment of FIG. 9, all cutting edges are so inclined in order to provide this advantageous result.

Stated otherwise, the oblique orientation of successive teeth in a ring of inserts 38, as well as the rings of inserts 46 and 44, has the effect that successive teeth impact the rock at different angles, much as the application of a chisel by a sculptor at many different angles would more rapidly chip away a piece of granite. Each insert 38, 46 and 44 is disposed in a cavity of substantially uniform depth. The relatively short height of the teeth, with respect to the face 42, of the cone 14, is a significant factor in reducing vibration. In contrast to the prior art structures which have teeth disposed with their cutting edges parallel to the center line or axis of rotation of the cone 14, the apparatus in accordance with the invention has the teeth or cutting edges disposed at different angles and this produces more rapid cutting.

Figure 2:
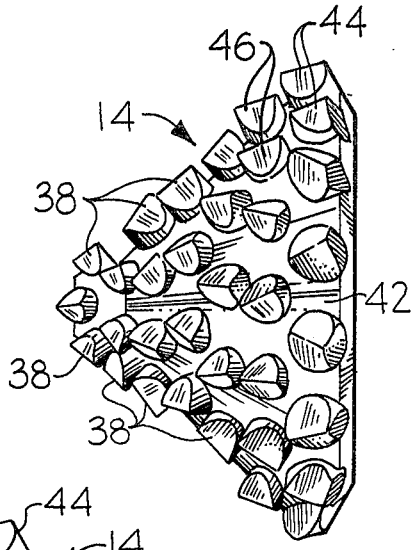
FIG. 2 is a simplified elevational view of one of the cones illustrated in FIG. 1.
Figure 3:
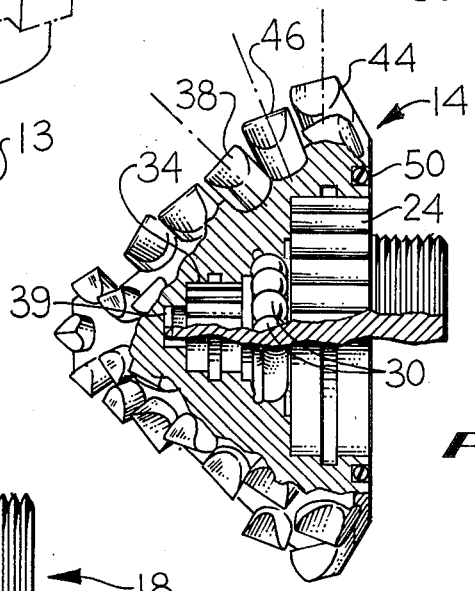
FIG. 3 is a broken away elevational view of a cone which is similar to that of FIG. 2 and which better illustrates the internal construction of the cone.

In general the inserts 38 are disposed with the axis of each in generally perpendicular relationship to the face 42 of the cone 14. In the embodiment illustrated in FIGS. 1–7, the inserts 38 extend approximately one-half inch above the face 42. This size has been found satisfactory for hard packed ground. Other sizes will be desirable for soft soil and rock conditions. The primary exception to this generally perpendicular relationship to the face 42, of the cone 14, is the rings of inserts 44 and 46. The inserts 44, 46 are otherwise identical to the inserts 38 except that they are oriented differently, as best seen in FIGS. 2 and 3. Specifically, the rightmost rings or rows of inserts 44 are disposed at increasing angles to the axis of the pin 18. The row or ring of inserts identified by the numeral 46 is disposed with the axes thereof at an angle which is intermediate the angular orientation of the inserts 38 and the inserts 44, as best seen in FIG. 3.

Disposed around the face of the cone 14 (on the right in FIG. 3) are a seal groove and seal 50 which are provided to keep contamination out of the bearings 24, 30, 34. It will be understood that this seal 50 cooperates with the leg 16 in which the cone 14 is mounted.

The apparatus in accordance with the invention provides much faster cutting and drilling than was provided by the prior bit assemblies. In part, this results from the elimination in the apparatus in accordance with the invention of the grooves separating pluralities of teeth. There are therefore a greatly increased number of teeth acting on the rock or formation, thus greatly increasing the rate of downward penetration of the drill bit.

Referring to the embodiments of FIGS. 8 and 9, rings of inserts 44A are provided in which successive inserts 44A are alternately offset or staggered, preferably being offset one-half diameter or more in alternate lateral directions. This construction is advantageous in that it provides better cutting and reduced teeth damage. Damage is otherwise more likely to occur in more conventional constructions, because a depression or "hole" may be produced in a portion of the bottom of the bore being drilled in which depression a tooth may bottom under the heavy pressures applied, and then be broken by the forces applied to the tooth against a surface or wall of such depression or hole. In other respects, the cone 42 is generally similar to the embodiment illustrated in FIGS. 1–7. The similarities include the rectilinear edge 40*a* orientations.

With inserts extending varying effective distances from the cone, as shown in FIGS. 3 and 7, as may be provided by inserts of varying lengths in cavities of equal depth, when the outermost cutting edges become worn or broken, other edges come into action, thereby providing improved drill bit performance throughout a longer service life.

The use of a relatively large number of individual teeth insures that even if one tooth were to wear abnormally, substantial cutting will continue, since the wear of any one tooth will merely place other teeth in more positive engagement with the rock formation which is being drilled. A single cone 14, in accordance with the invention, has more inserts 38 than the entire drill bit assembly, in accordance with the prior art. Stated another way, the number of inserts 38 is about four times the number of inserts in prior art structures. Another benefit of the relatively large number of inserts 38, 46, and 44 is more uniform and lower-magnitude shocks and vibrations on the bearings, thus resulting in substantially reduced bearing overloading and fatigue, thereby increased bearing life.

Still another benefit of the construction, in accordance with the invention, is that the resultant force on each cone 14 results in a force disposed generally along the axis of rotation of the drill bit. This tends to avoid a spiralling movement of the drill bit assembly into the earth, and thus results in a more efficient and faster drilling action. The resultant force is more closely aligned with the axis of the cone 14, than in the prior art structures, primarily because the greater number of teeth insure a distribution of forces which are substantially uniform about the circumference of the cone 14.

The angular orientation of the ring of inserts 46 and the rings of inserts 44 tends to maintain the size of the hole being bored by the drill bit and thus provides more clearance for the drill bit. A slight enlargement also tends to increase bearing and seal life because the load on the bit 10 is decreased. Contrary to the practice conventionally used, reaming of the hole is not necessary to accommodate a new drill bit, merely because the bit that was used previously was worn and thus cut a hole of reduced diameter.

The drill bit assembly 10 illustrated in FIG. 1 has a height of about eighteen inches and has an outside diameter of about eight and three-quarter inches. Various other embodiments may have substantially larger dimensions.

The boring bit assemblies according to the invention are more durable and provide longer service life than bits of the prior art, and are capable of drilling faster and farther before it is necessary to replace the drill bit.

The invention has been described with reference to its illustrated preferred embodiment. Persons skilled in the art of constructing rock drill bits may, upon exposure to the teachings herein, conceive variations in the mechanical development of the components therein.

The inventor claims:

1. A rock boring bit assembly comprising:

a body adapted for engagement with associated driving components;

at least one cone rotatively mounted on said body, said cone having an axis;

each cone including a plurality of cutting members disposed over substantially all the conical face thereof in generally upstanding relationship to the face, said cutting members having generally rectilinear edges; and at least some of said cutting members being disposed in a plurality of rings, all of said rings extending around said axis, each of said plurality of rings being axially spaced along said axis and overlapping with at least one other ring and having the cutting members of the respective rings interspersed.

2. The apparatus according to claim 1, wherein:

said cutting member edges are disposed in oblique relationship to the axis of the cone.

3. The apparatus as described in claim 1, wherein: said cutting members included in any one cone are welded to that cone.

4. The apparatus as described in claim 2, wherein: said cutting members included in any one cone are welded to that cone.

5. The apparatus according to claim 1 or 2, wherein: each of said cutting member edges within any one ring is disposed in oblique relationship to the rectilinear edges of at least a plurality of other cutting members proximate thereto.

6. The apparatus according to claim 2, and further including:

a first ring of cutting members disposed at the axial extremity of at least one cone and most remote from the apex of that cone, each cutting member in said first ring having its geometric axis in substantially normal relationship to the axis of the cone.

7. The apparatus according to claim 5, wherein:

the cutting member edges within at least some rings of said plurality of rings alternate in directions of inclination relative to the cone axis.

8. The apparatus according to claim 2, wherein:

each of said cones is mounted on a bearing pin; and the apparatus includes bearing means between said cone and said bearing pin, including a plurality of bearings.

9. The apparatus according to claim 1, wherein:

each of said cones is mounted on a bearing pin; and the apparatus includes bearing means between said cone and said bearing pin, including a plurality of bearings.

10. The apparatus according to claim 5, and further including:

a first ring of cutting members disposed at the axial extremity of at least one cone and most remote from the apex of that cone, each cutting member in said first ring having its geometric axis in substantially normal relationship to the axis of the cone.

11. The apparatus according to claim 6, wherein:

each of said cones further includes a second ring of elongated cutting members disposed with the axis of each at an angle which is intermediate a normal to the axis of the ring of cutting members which are most remote from the apex and a normal to the surface of the cone of the cutting inserts disposed elsewhere on this cone, said second ring being disposed axially intermediate said ring of inserts which is most remote from said apex and the cutting inserts disposed elsewhere on said cone.

12. The apparatus according to claim 10, wherein:

each of said cones further includes a second ring of elongated cutting members disposed with the axis of each at an angle which is intermediate a normal to the axis of the ring of cutting members which are most remote from the apex and a normal to the surface of the cone of the cutting inserts disposed elsewhere on this cone, said second ring being disposed axially intermediate said ring of inserts which is most remote from said apex and the cutting inserts disposed elsewhere on said cone.

* * * * *